US008082905B2

(12) United States Patent
Mai et al.

(10) Patent No.: US 8,082,905 B2
(45) Date of Patent: Dec. 27, 2011

(54) TANK VENTING DEVICE FOR A MOTOR VEHICLE

(75) Inventors: Wolfgang Mai, Kronberg (DE); Jens Pache, Kaufungen (DE)

(73) Assignee: Continental Automotive GmbH, Hannover (DE)

( * ) Notice: Subject to any disclaimer, the term of this patent is extended or adjusted under 35 U.S.C. 154(b) by 478 days.

(21) Appl. No.: 12/325,305

(22) Filed: Dec. 1, 2008

(65) Prior Publication Data

US 2009/0139989 A1 Jun. 4, 2009

(30) Foreign Application Priority Data

Nov. 30, 2007 (DE) ..... 10 2007 057 693

(51) Int. Cl.
*F02M 33/02* (2006.01)

(52) U.S. Cl. ..... 123/518; 123/519; 123/520

(58) Field of Classification Search ..... 123/516, 123/518, 519, 520
See application file for complete search history.

(56) References Cited

U.S. PATENT DOCUMENTS

| | | | | | |
|---|---|---|---|---|---|
| 4,817,576 | A | * | 4/1989 | Abe et al. | 123/519 |
| 4,836,172 | A | * | 6/1989 | Haruta et al. | 123/520 |
| 4,887,578 | A | * | 12/1989 | Woodcock et al. | 123/519 |
| 4,919,103 | A | * | 4/1990 | Ishiguro et al. | 123/514 |
| 4,951,643 | A | * | 8/1990 | Sato et al. | 123/520 |
| 5,027,780 | A | * | 7/1991 | Uranishi et al. | 123/520 |
| 5,056,494 | A | | 10/1991 | Kayanuma | 123/519 |
| 5,174,265 | A | * | 12/1992 | Sekine | 123/520 |
| 5,277,168 | A | * | 1/1994 | Kondo et al. | 123/519 |
| 5,363,828 | A | * | 11/1994 | Yamashita et al. | 123/520 |
| 5,456,236 | A | * | 10/1995 | Wakashiro et al. | 123/519 |
| 5,456,237 | A | * | 10/1995 | Yamazaki et al. | 123/520 |
| 5,460,136 | A | * | 10/1995 | Yamazaki et al. | 123/519 |
| 5,477,836 | A | * | 12/1995 | Hyodo et al. | 123/519 |
| 5,487,369 | A | * | 1/1996 | Hara et al. | 123/520 |
| 5,596,971 | A | * | 1/1997 | Kidokoro | 123/516 |
| 5,603,349 | A | * | 2/1997 | Harris | 137/588 |
| 5,632,252 | A | * | 5/1997 | Hyodo et al. | 123/520 |
| 5,653,211 | A | * | 8/1997 | Ishikawa | 123/520 |
| 5,692,480 | A | * | 12/1997 | Kato et al. | 123/519 |
| 5,769,057 | A | * | 6/1998 | Hashimoto et al. | 123/516 |
| 5,816,287 | A | * | 10/1998 | Hyodo et al. | 137/587 |
| 5,819,796 | A | * | 10/1998 | Kunimitsu et al. | 137/587 |
| 5,870,997 | A | * | 2/1999 | Mukai | 123/520 |
| 6,418,915 | B1 | * | 7/2002 | Harrigan, Sr. | 123/520 |
| 6,739,310 | B2 | | 5/2004 | Esteghlal et al. | 123/295 |

FOREIGN PATENT DOCUMENTS

| | | | |
|---|---|---|---|
| DE | 19836102 | C2 | 4/2003 |
| DE | 102005054880 | B3 | 6/2007 |
| EP | 1317617 | B1 | 2/2006 |

* cited by examiner

*Primary Examiner* — Thomas Moulis
(74) *Attorney, Agent, or Firm* — King & Spalding L.L.P.

(57) ABSTRACT

A tank venting device for a motor vehicle has a fuel tank, a fuel vapor accumulator for storing fuel vapors escaping from the fuel tank and a connection line, via which the fuel vapors may flow from the fuel tank into the fuel vapor accumulator. Furthermore, an overpressure line having an overpressure valve is provided, via which the fuel vapors may flow from the fuel tank into the fuel vapor accumulator when the overpressure valve is open. An attachment of the connection line on the fuel vapor accumulator and an attachment of the overpressure line on the fuel vapor accumulator are situated at different points on the fuel vapor accumulator. The operational reliability of a tank venting procedure may thus be increased and the adsorption capacity of the fuel vapor accumulator may be used better.

12 Claims, 1 Drawing Sheet

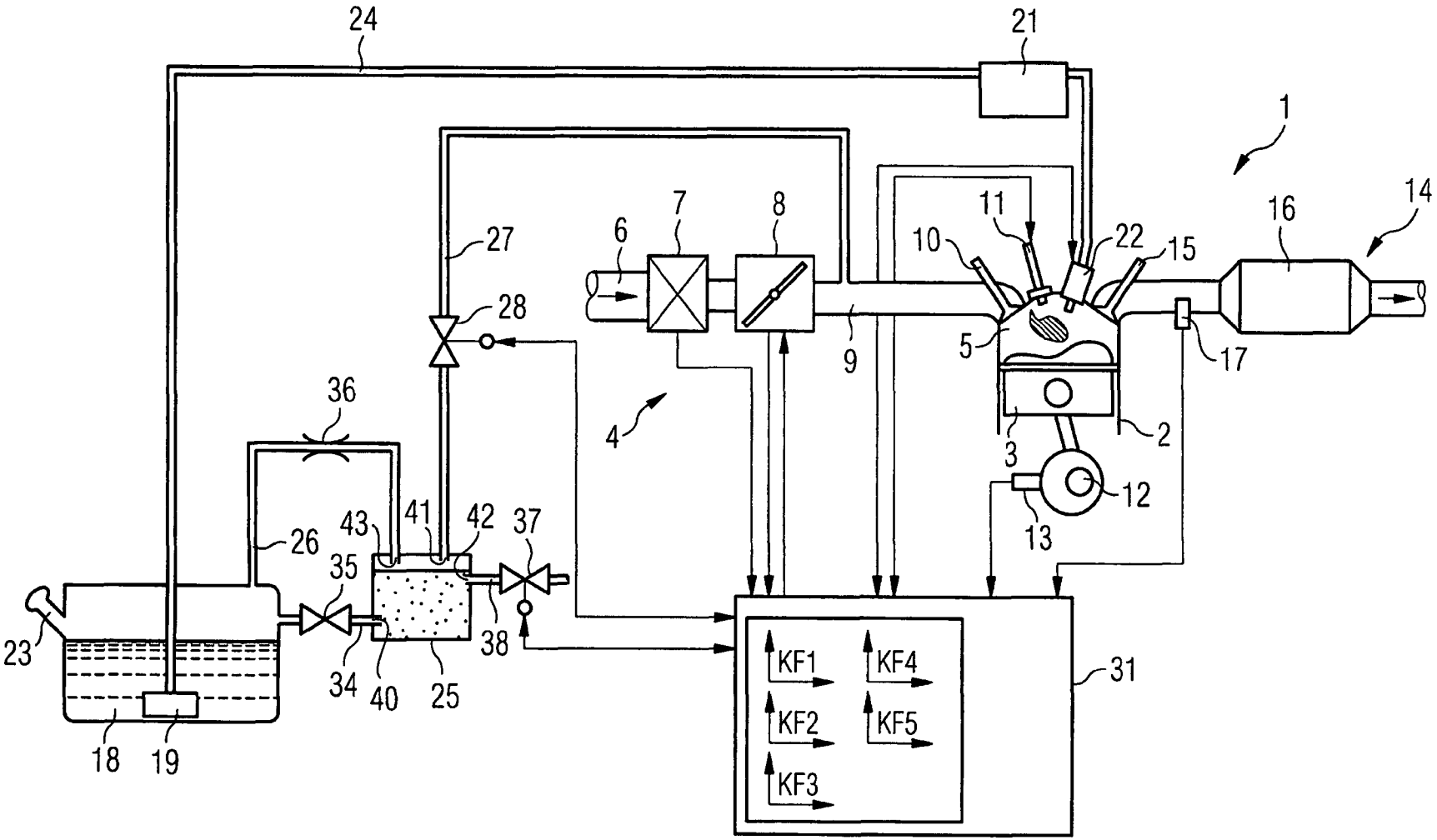
1
2
3
4
5
6
7
8
9
10
11
12
13
14
15
16
17
18
19
21
22
23
24
25
26
27
28
31
34
35
36
37
38
40
41
42
43
KF1
KF2
KF3
KF4
KF5

TANK VENTING DEVICE FOR A MOTOR VEHICLE

CROSS-REFERENCE TO RELATED APPLICATIONS

This application claims priority to German Patent Application No. 10 2007 057 693.7 filed Nov. 30, 2007, the contents of which is incorporated herein by reference in its entirety.

TECHNICAL FIELD

The invention relates to a tank venting device for a motor vehicle.

BACKGROUND

Because of the ever stricter emission limiting values for motor vehicles, they typically have a so-called tank venting device. The core of the tank venting device is a fuel vapor accumulator, which may be implemented as an activated carbon container, for example. The fuel vapors escaping from the fuel tank are supplied to the activated carbon container via a connection line and absorbed therein by the activated carbon. The activated carbon container is also connected via a venting line to the intake manifold of an internal combustion engine of the motor vehicle, a tank venting valve being situated in the venting line. The activated carbon container is regenerated in specific operating states of the internal combustion engine, in that the tank venting valve is opened and the absorbed fuel vapors are thus supplied via the intake manifold to the internal combustion engine and participate in the combustion therein. The activated carbon container may also be connected to the surroundings via a ventilation line and a ventilation valve situated therein. During a tank venting procedure, the ventilation valve is opened to achieve a flushing effect.

A tank venting device according to the preamble of claim 1 is known from U.S. Pat. No. 5,056,494.

SUMMARY

According to various embodiments, an improved tank venting device for a motor vehicle can be provided.

According to an embodiment, a tank venting device for a motor vehicle, may comprise a fuel tank, a fuel vapor accumulator for storing fuel vapors escaping from the fuel tank, a connection line, via which the fuel vapors may flow from the fuel tank into the fuel vapor accumulator, an overpressure line having an overpressure valve, via which the fuel vapors may flow from the fuel tank into the fuel vapor accumulator when the overpressure valve is open, a venting line, via which the fuel vapors contained in the fuel vapor accumulator may be supplied to an internal combustion engine, and an attachment of the connection line on the fuel vapor accumulator and an attachment of the overpressure line on the fuel vapor accumulator being situated at different points on the fuel vapor accumulator, wherein the attachment of the overpressure line on the fuel vapor accumulator is spaced farther apart from an attachment of the venting line on the fuel vapor accumulator than the attachment of the connection line on the fuel vapor accumulator.

According to a further embodiment, the attachment of the overpressure line on the fuel vapor accumulator can be spaced as far apart as possible from the attachment of the venting line on the fuel vapor accumulator. According to a further embodiment, the attachment of the connection line on the fuel vapor accumulator and the attachment of the venting line on the fuel vapor accumulator can be situated as close as possible to one another. According to a further embodiment, the tank venting device may comprise a ventilation line, via which the fuel vapor accumulator may be connected to the surroundings, the attachment of the overpressure line on the fuel vapor accumulator being spaced as far apart as possible from an attachment of the ventilation line on the fuel vapor accumulator. According to a further embodiment, the cross-section of the connection line may be dimensioned in at least a partial section in such a way that an overpressure at least temporarily prevails in the fuel tank in relation to the ambient pressure. According to a further embodiment, a throttle element can be situated in the connection line.

BRIEF DESCRIPTION OF THE DRAWINGS

The invention is explained in greater detail hereafter on the basis of an exemplary embodiment with reference to the appended FIGURE.

FIG. 1 shows a schematic illustration of an internal combustion engine having a tank venting device.

DETAILED DESCRIPTION

A tank venting device for motor vehicles according to an embodiment comprises a fuel tank and a fuel vapor accumulator for storing the fuel vapors escaping from the fuel tank. The tank venting device also has a connection line, via which the fuel vapors may flow from the fuel tank into the fuel vapor accumulator. Furthermore, an overpressure line having an overpressure valve situated therein is provided, via which the fuel vapors may flow from the fuel tank into the fuel vapor accumulator when the overpressure valve is open—i.e., upon exceeding a limiting pressure in the fuel tank. The tank venting device additionally comprises a venting line, via which the fuel vapors contained in the fuel vapor accumulator may be supplied to an internal combustion engine. An attachment of the connection line on the fuel vapor accumulator and the attachment of the overpressure line on the fuel vapor accumulator are situated at different points on the fuel vapor accumulator. The attachment of the overpressure line on the fuel vapor accumulator is spaced further away from an attachment of the venting line on the fuel vapor accumulator than the attachment of the connection line on the fuel vapor accumulator.

The attachment of the overpressure line on the fuel vapor accumulator is advantageously situated as far as possible from the attachment of the venting line on the fuel vapor accumulator.

Because the tank venting device has a connection line and a separate overpressure line, each having attachments situated differently on the fuel vapor accumulator, a higher flexibility results in the constructive embodiment and optimization possibilities of the tank venting device. Thus, for example, the connection line may be dimensioned in such a way that an overpressure at least temporarily prevails in the fuel tank, whereby the vaporization tendency of the fuel in the fuel tank is reduced. In this way, either the storage volume of the fuel vapor accumulator or the number of tank venting procedures to be performed may be reduced. Because of the presence of a separate overpressure line, the tank venting device is secured against excess pressure increase in the fuel tank, however. Because the attachments of the connection line and the overpressure line on the fuel vapor accumulator are situated at different points, by suitable selection of these attachment points, an increased operational reliability of the tank venting procedure may be achieved while concurrently having lower absorption load of the fuel vapor accumulator. The tank venting device according to the invention prevents fuel vapors from unpredictably reaching the venting line during a tank venting procedure, in which the fuel vapors are supplied via the venting line to the internal combustion engine, upon sudden opening of the overpressure valve, and thus resulting in an uncontrolled disturbance of the combustion mixture composition. A disturbance of this type may result at worst in the internal combustion engine dying, but at least in uncomfortable driving behavior of the motor vehicle. Due to the spacing of the attachment of the overpressure line as far as possible from the venting line, uncontrolled exiting fuel vapors do not reach the venting line directly via the overpressure line, but first flow into the activated carbon bed of the fuel vapor accumulator and are largely absorbed therein. In this way, undesired disturbances of the combustion mixture composition are prevented. The operational reliability of a tank venting procedure may thus be significantly increased.

In a further embodiment of the tank venting device, the attachment of the connection line on the fuel vapor accumulator and the attachment of the venting line on the fuel vapor accumulator are situated as close as possible to one another.

The various embodiments of the tank venting device have the advantage that during a tank venting procedure, the fuel vapors flowing out of the connection line reach the venting line in a short distance and the adsorption bed of the fuel vapor accumulator is kept small. In this way, the tank venting procedure may be performed more rapidly and the load of the fuel vapor accumulator may be reduced.

A further embodiment of the tank venting device has a ventilation line, via which the fuel vapor accumulator may be connected to the surroundings. The attachment of the overpressure line on the fuel vapor accumulator is spaced as far as possible from an attachment of the ventilation line on the fuel vapor accumulator.

This embodiment has the advantage that fuel vapors exiting suddenly from the overpressure line may not escape directly via an open venting line into the surroundings, but rather are conducted into the adsorption bed of the fuel vapor accumulator and absorbed therein. The emission behavior of the tank venting device may thus be improved.

In a further embodiment of the tank venting device, the cross-section of the connection line is dimensioned in at least a partial section in such a way that an overpressure at least temporarily prevails in the fuel tank in relation to the ambient pressure.

To achieve this effect, according to a further embodiment, a throttle element may be situated in the connection line.

Some embodiments have the advantage that the outgassing tendency of the fuel contained therein may be significantly reduced by the at least temporarily prevailing overpressure in the fuel tank. This results in a lower load of the fuel vapor accumulator, whereby tank venting procedures must be performed less often. The configuration of a throttle element in the connection line is a cost effective solution for this purpose.

The internal combustion engine 1 has at least one cylinder 2 and one piston 3, which is movable back-and-forth in the cylinder 2. The fresh air necessary for the combustion is introduced via an intake system 4 into a combustion chamber 5 delimited by the cylinder 2 and the piston 3. An air-flow sensor 7 for detecting the air flow rate in the intake system 4, a throttle valve 8 for controlling the air flow rate, an intake manifold 9 and an inlet valve 10, using which the combustion chamber 5 is alternately connected or disconnected from the intake system 4, are located downstream from an intake opening 6.

The triggering of the combustion is performed using a sparkplug 11. The drive energy generated by the combustion is transmitted via a crankshaft 12 to the drivetrain of the motor vehicle (not shown). A speed sensor 13 detects the speed of the internal combustion engine 1.

The combustion exhaust gases are exhausted via an exhaust system 14 of the internal combustion engine 1. The combustion chamber 5 is alternately connected to or disconnected from the exhaust system 14 using an outlet valve 15. The exhaust gases are purified in an exhaust purification catalytic converter 16. Furthermore, a so-called lambda sensor 17 for measuring the oxygen content in the exhaust gas is located in the exhaust system 14.

The internal combustion engine 1 also comprises a fuel supply unit having a fuel tank 18, a fuel pump 19, a pressure accumulator 21, and at least one controllable fuel injector 22. The fuel tank 18 has a closable filler tube 23 for filling fuel. The fuel is supplied to the pressure accumulator 21 using the fuel pump 19 via a fuel supply line 24. The pressure accumulator 21 is used as a shared pressure accumulator 21 for all fuel injectors 22. All fuel injectors 22 are supplied with pressurized fuel therefrom. In the exemplary embodiment, it is an internal combustion engine 1 having fuel direct injection, in which the fuel is injected directly into the combustion chamber 5.

A control device 31 is assigned to the internal combustion engine 1, in which ignition-map-based engine control functions (KF1 through KF5) are implemented by software. The control device 31 is connected to all actuators and sensors of the internal combustion engine 1 via signal and data lines. In particular, the control device 31 is connected to the air-flow sensor 7, the controllable throttle valve 8, the injection valve 22, the sparkplug 11, the lambda sensor 17, and the speed sensor 13.

Furthermore, a tank venting device is assigned to the internal combustion engine 1. The core of the tank venting device is a fuel vapor accumulator 25. The fuel tank 18 is connected via a connection line 26 to the fuel vapor accumulator 25 in such a way that the fuel vapors contained in the fuel tank 18 may escape via the connection line 26 to the fuel vapor accumulator 25. For example, the fuel vapor accumulator 25 is implemented as an activated carbon container, so that the fuel vapors escaping from the fuel tank 18 are adsorbed by the activated carbon (shown by dots in FIG. 1) and stored in the fuel vapor accumulator 25 in this way. The connection line 26 is advantageously implemented in such a way that an overpressure forms at least temporarily in the fuel tank 18 because of the outgassing of the fuel contained therein. The vaporization process of the fuel is noticeably reduced by the overpressure in the fuel tank 18, so that the total quantity of fuel vapors and thus the charge of the fuel vapor accumulator 25 is decreased. To achieve this overpressure, the connection line 26 may entirely or sectionally have an appropriately decreased cross-section or a suitable throttle element 36 (perforated screen).

To avoid high pressures in the fuel tank 18, the fuel tank 18 is connected for safety reasons to the fuel vapor accumulator 25 via an overpressure line 34 having an overpressure valve 35 situated therein. If a limiting pressure or switching pressure is exceeded, the overpressure about 35 opens and fuel vapors may escape via the overpressure line into the fuel vapor accumulator 25.

The fuel vapor accumulator 25 is also connected via a venting line 27 to the intake system 4, advantageously to the intake manifold 9 of the internal combustion engine 1. A controllable tank venting valve 28 is situated in the venting line 27, which is connected to the control unit 31 and may be alternately opened or closed thereby. When tank venting valve 28 is open, because of the partial vacuum in intake manifold 9, fuel vapors flow from the fuel vapor accumulator 25 into the intake manifold 9, flow therefrom together with the fresh air into the combustion chamber 5 and participate in the combustion therein.

The fuel vapor accumulator 25 is connected via a ventilation line 38 and a controllable ventilation valve 37 situated therein to the surroundings. The ventilation valve 37 is also coupled to the control device 31 and may be alternately opened or closed thereby.

To avoid an overload of the fuel vapor accumulator 25 with fuel vapors, it must be regenerated from time to time. For this purpose, a tank venting procedure is performed in specific operating states of the internal combustion engine 1, for example in idle or lower part-load range. For this purpose, the tank venting valve 28 and the ventilation valve 37 are opened. Because of the strong low pressure in the intake manifold 9, the fuel vapor accumulator 25 is flushed, wherein the adsorbed fuel vapors flow via the venting line 27 into the intake manifold 9, reaching the combustion chamber 5 of the internal combustion engine 1 therefrom with the fresh air, and participating in the combustion. The fuel vapor accumulator 25 is simultaneously filled with fresh air via the ventilation line 38 and the open ventilation valve 37. After a tank venting procedure, the fuel vapor accumulator 25 is again ready to receive fuel vapors.

Because the fuel tank 18 is connected via a connection line 26 and additionally via a separate overpressure line 34 to the fuel vapor accumulator 25, a high flexibility results in the constructive design of the tank venting device, whereby the operational reliability of tank venting procedures and also the emission behavior of the tank venting device may be optimized. Thus, in the exemplary embodiment, an attachment 40 of the overpressure line 34 on the fuel vapor accumulator 25 is spaced farther apart from an attachment 41 of the venting line 27 on the fuel vapor accumulator 25 than an attachment 43 of the connection line 26. The attachment 43 of the connection line 26 is situated as close as possible to the attachment 41 of the venting line 27. The advantage thus results that the fuel vapors flowing during a tank venting procedure via the connection line 26 into the fuel vapor accumulator 25 largely reach the venting line 27 directly without loading the activated carbon bed of the fuel vapor accumulator 25. The tank venting procedure may be performed more rapidly and the activated carbon bed may be relieved in this way.

The attachment 40 of the overpressure line 34 is advantageously spaced as far apart as possible from the attachment 41 of the venting line 27. The reason for this is that in the event of sudden opening of the overpressure valve 35 during a tank venting procedure, larger quantities of fuel vapors suddenly reach the fuel vapor accumulator 25. Because the attachments 40, 41 of the overpressure line 34 and the venting line 27 are spaced far part, these fuel vapors are first conducted through the activated carbon bed of the fuel vapor accumulator 25, where they are largely absorbed. In this way, only a small quantity of fuel vapors reach the venting line 27 from the overpressure line 34. The tank venting procedure may thus occur in a more controlled way and disturbances in the fuel mixture composition, which could result in dying of the internal combustion engine 1 at worst, are reliably avoided.

Furthermore, it is advantageous if the attachment 40 of the overpressure line 34 on the fuel vapor accumulator 25 is spaced as far apart as possible from the attachment 42 of the venting line 38 on the fuel vapor accumulator 25. In this way, upon sudden opening of the overpressure valve 35, larger quantities of fuel vapors are prevented from being released to the surroundings in an uncontrolled way via an open ventilation valve 37. Because the attachments 40, 42 of the overpressure line 34 and the ventilation line 38 are spaced far apart, the fuel vapors escaping from the overpressure line must first flow through the activated carbon bed of the fuel vapor accumulator and are largely adsorbed therein.

The emission behavior of the tank venting device and operational reliability of the tank venting procedures may be significantly improved by the tank venting device according to the invention.

What is claimed is:

1. A tank venting device for a motor vehicle, comprising a fuel tank, a fuel vapor accumulator for storing fuel vapors escaping from the fuel tank, the fuel vapor accumulator including an activated bed, a connection line, via which the fuel vapors may flow from the fuel tank into the fuel vapor accumulator, an overpressure line having an overpressure valve, via which the fuel vapors may flow from the fuel tank into the fuel vapor accumulator when the overpressure valve is open, a venting line, via which the fuel vapors contained in the fuel vapor accumulator may be supplied to an internal combustion engine, an attachment of the connection line on the fuel vapor accumulator and an attachment of the overpressure line on the fuel vapor accumulator being situated at different points on the fuel vapor accumulator, wherein the attachment of the overpressure line on the fuel vapor accumulator is arranged relative to an attachment of the venting line on the fuel vapor accumulator such that fuel vapor flow from the overpressure line to the venting line necessarily flows through the activated bed of the fuel vapor accumulator, and wherein the attachment of the connection line on the fuel vapor accumulator relative to the attachment of the venting line on the fuel vapor accumulator defines a path for fuel vapor flow from the connection line to the venting line that avoids flowing through the activated bed of the fuel vapor accumulator.

2. The tank venting device according to claim 1, wherein the attachment of the overpressure line on the fuel vapor accumulator the attachment of the venting line on the fuel vapor accumulator are located proximate opposite sides of the fuel vapor accumulator.

3. The tank venting device according to claim 1, wherein the attachment of the connection line on the fuel vapor accumulator and the attachment of the venting line on the fuel vapor accumulator are both located on a top side of the fuel vapor accumulator.

4. The tank venting device according to claim 1, comprising a ventilation line, via which the fuel vapor accumulator may be connected to the surroundings, wherein the attachment of the overpressure line on the fuel vapor accumulator and an attachment of the ventilation line on the fuel vapor accumulator are located proximate opposite sides of the fuel vapor accumulator.

5. The tank venting device according to claim 1, wherein the cross-section of the connection line is dimensioned in at least a partial section in such a way that an overpressure at least temporarily prevails in the fuel tank in relation to the ambient pressure.

6. The tank venting device according to claim 5, wherein a throttle element is situated in the connection line.

7. A method for venting a tank of a motor vehicle, comprising the steps of:

providing a fuel tank, storing fuel vapors escaping from the fuel tank in a fuel vapor accumulator via a connection line, the fuel vapor accumulator including an activated bed, providing an overpressure line having an overpressure valve, via which the fuel vapors may flow from the fuel tank into the fuel vapor accumulator when the overpressure valve is open, providing a venting line, via which the fuel vapors contained in the fuel vapor accumulator may be supplied to an internal combustion engine, and providing an attachment of the connection line on the fuel vapor accumulator and an attachment of the overpressure line on the fuel vapor accumulator being situated at different points on the fuel vapor accumulator, wherein the attachment of the overpressure line on the fuel vapor accumulator is arranged relative to an attachment of the venting line on the fuel vapor accumulator such that fuel vapor flow from the overpressure line to the venting line necessarily flows through the activated bed of the fuel vapor accumulator, and wherein the attachment of the connection line on the fuel vapor accumulator relative to the attachment of the venting line on the fuel vapor accumulator defines a path for fuel vapor flow from the connection line to the venting line that avoids flowing through the activated bed of the fuel vapor accumulator.

8. The method according to claim 7, wherein the attachment of the overpressure line on the fuel vapor accumulator the attachment of the venting line on the fuel vapor accumulator are located proximate opposite sides of the fuel vapor accumulator.

9. The method according to claim 7, wherein the attachment of the connection line on the fuel vapor accumulator and the attachment of the venting line on the fuel vapor accumulator are both located on a top side of the fuel vapor accumulator.

10. The method according to claim 7, further comprising the step of providing a ventilation line, via which the fuel vapor accumulator may be connected to the surroundings, wherein the attachment of the overpressure line on the fuel vapor accumulator and an attachment of the ventilation line on the fuel vapor accumulator are located proximate opposite sides of the fuel vapor accumulator.

11. The method according to claim 7, wherein the cross-section of the connection line is dimensioned in at least a partial section in such a way that an overpressure at least temporarily prevails in the fuel tank in relation to the ambient pressure.

12. The method according to claim 1 wherein a throttle element is situated in the connection line.

* * * * *